US006247911B1

(12) United States Patent
Milligan

(10) Patent No.: US 6,247,911 B1
(45) Date of Patent: Jun. 19, 2001

(54) MELT BLOWING DIE

(75) Inventor: Mancil W. Milligan, Luttrell, TN (US)

(73) Assignee: The University of Tennessee Research Corporation, Knoxville, TN (US)

( * ) Notice: Subject to any disclaimer, the term of this patent is extended or adjusted under 35 U.S.C. 154(b) by 0 days.

(21) Appl. No.: 09/315,590

(22) Filed: May 20, 1999

(51) Int. Cl.[7] ..... B29B 9/06
(52) U.S. Cl. ..... 425/7; 425/72.2
(58) Field of Search ..... 425/72.2, 382 R, 425/382.2, 464, 382 IV, 7; 264/211.14, 12

(56) References Cited

U.S. PATENT DOCUMENTS 4,908,163 * 3/1990 McAmish et al. ..... 264/12
5,080,569 * 1/1992 Gubernick et al. ..... 425/7
5,580,581 * 12/1996 Buehning ..... 425/7
5,695,377 * 12/1997 Triebes et al. ..... 442/359
5,976,431 * 11/1999 Mears ..... 264/40.1

* cited by examiner

*Primary Examiner*—Robert Davis
*Assistant Examiner*—Joseph S Del Sole
(74) *Attorney, Agent, or Firm*—Duane, Morris & Heckscher LLP

(57) ABSTRACT

The present invention relates to an improved die for use in textile processes involving nonwoven melt blown fabrics. In a melt blown process, molten polymer resins are injected into a melt blowing die and ejected or extruded from the die in the form of filaments. The present invention is directed to an improved die faceplate in combination with an extension plate that provides an extended flow path for an air jet to extrude a molten polymer filament of a reduced diameter in the melt blowing process.

19 Claims, 3 Drawing Sheets

MELT BLOWING DIE

BACKGROUND OF THE INVENTION

1. Field of the Invention

The present invention relates to an improved die for use in textile processes involving nonwoven melt blown fabrics. In a melt blown process, molten polymer resins are injected into a melt blowing die and ejected or extruded from the die in the form of filaments. The present invention is directed to an improved die faceplate in combination with an extension plate that provides an extended flow path for an air jet to extrude a molten polymer filament of a reduced diameter in the melt blowing process.

2. Description of the Prior Art

Prior art dies comprise a resin nosepiece comprising an outer surface, a tip, and a resin flow channel extending to the tip. These nosepieces are usually adjacent to one or more air channels such that a stream of air flowing through the air channel past the tip pulls and attenuates the molten filament. The drag force of the air stream places a tensile stress on the attenuated filaments, thereby reducing their diameter. An upper faceplate and a lower faceplate are placed in front of the nosepiece and spaced apart to define a faceplate slit such that polymer filaments extruded from the nosepiece may flow through the faceplate slit within the air stream.

In prior art nosepieces, once the filament is extended beyond the faceplate slit, it is exposed to the entrained air which reduce the force acting upon it. This reduction in drag force limits the amount of drag pull acting upon the filament in the melt blowing process, thereby limiting the final diameter of the filament.

SUMMARY OF THE INVENTION

The present invention is directed toward a melt blowing die comprising a resin nosepiece comprising an outer surface, a tip, and a resin flow channel extending to the tip.

The invention further comprises an air channel adjacent to the outer surface of the nosepiece. The air channel comprises a forward segment extending beyond the tip of the nosepiece.

The invention further comprises an upper faceplate and a lower faceplate, spaced apart to define a faceplate slit. The faceplate slit is aligned with the forward segment of the air channel such that resin filaments extruded from the nosepiece tip may extend through the forward segment of the air channel and the faceplate slit. Each faceplate further comprises an inner surface facing the tip and an outer surface facing away from the tip.

The invention further comprises an upper extension plate mounted on the outer surface of the upper faceplate and a lower extension plate mounted on the outer surface of the lower faceplate. The upper and lower extension plates are spaced apart to define a flow channel in alignment with the faceplate slit.

DESCRIPTION OF THE PREFERRED EMBODIMENTS

Figure 1A:
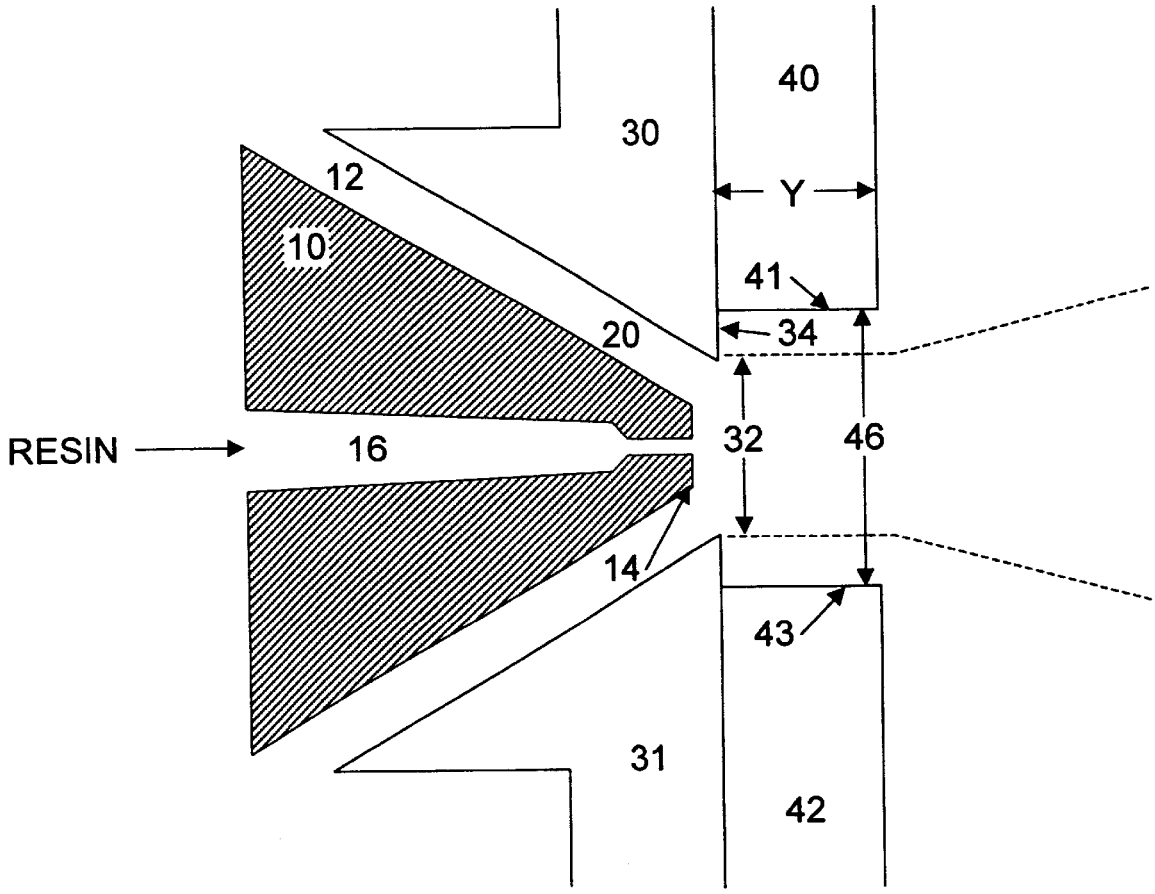
FIG. 1A is a side cross sectional view of an embodiment of the present invention.
Figure 1B:
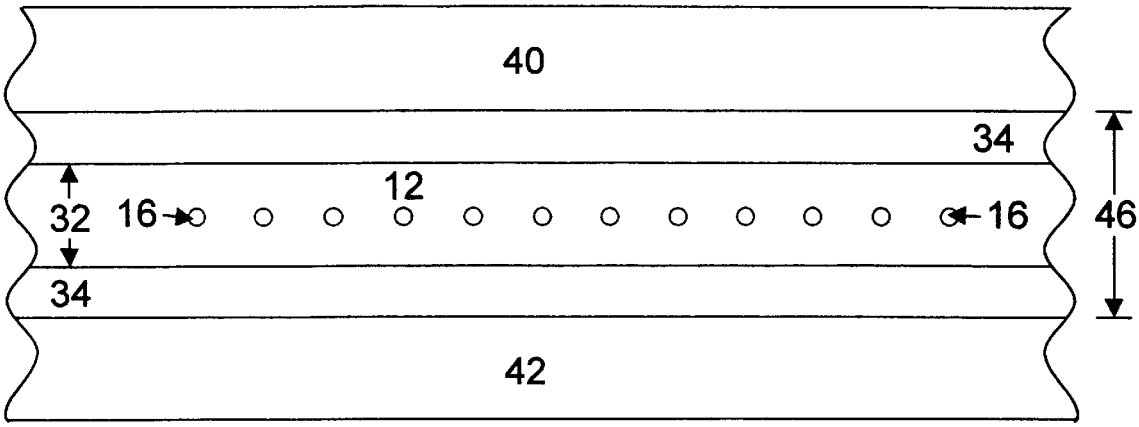
FIG. 1B is a front view of the embodiment of the present invention depicted in FIG. 1A.

The present invention is directed toward a melt blowing die comprising a resin nosepiece 10 comprising an outer nosepiece surface 12 a tip 14 and a resin channel 16 extending to the tip, as shown in FIG. 1A. As shown in FIG. 1A, the tip points in a fortward direction. In a preferred embodiment, the nosepiece comprises a multiplicity of resin channels as shown in FIG. 1B. In another preferred embodiment, the resin channels are evenly spaced in said nosepiece at a linear density in the range of 20 to 35 channels/inch. In another preferred embodiment, the resin channel density is 30 channels/inch.

The invention further comprises an air channel 20 adjacent to the outer surface of the nosepiece. The air channel comprises a forward segment extending beyond the tip of the nosepiece, as shown in FIG. 1A.

The invention further comprises an upper faceplate 30 and a lower faceplate 31 spaced apart to define a faceplate slit 32 aligned with the forward segment of the air channel, as shown in FIG. 1A. Each faceplate further comprises an outer surface 34 facing away from the tip, as shown in FIG. 1A. In a preferred embodiment, as shown in FIGS. 1A and 2, the outer surface of each faceplate 34 is straight.

As shown in FIG. 1A, the outer upper faceplate surface and the outer lower faceplate surface face in a forward direction away from the tip. As further shown in FIG. 1A, the outer upper faceplate surface and the outer lower faceplate surface are straight along their entire length.

The invention further comprises an upper extension plate 40 mounted on the outer surface of the upper faceplate and a lower extension plate 42 mounted on the outer surface of the lower faceplate. The upper extension plate comprises a first edge 41. The lower extension plate comprises a second edge 43. The first and second edges are spaced apart to define a flow channel 46 in alignment with the faceplate slit, as shown in FIG. 1A. As shown in FIG. 1A the faceplates and the extension plates are positioned such that no portion of the upper and lower faceplates extends into flow channel 46.

Figure 2:
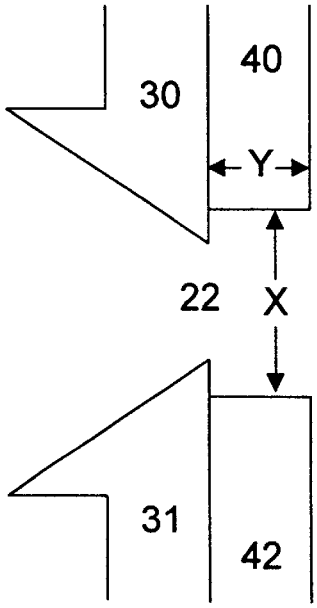
FIG. 2 is a side cross sectional view of a first embodiment of a faceplate and extension plate of the present invention.

In a preferred embodiment, the width of the flow channel, X, is in a range of 0.25 to 1.0 inches as shown in FIG. 2. In another preferred embodiment, the thickness of the upper and lower extension plates, Y, is in a range of 0.25 to 1.0 inches. The phrase "thickness of the upper and lower extension plates", as used herein, means the thickness in the dimension Y, as shown in FIGS. 1A and 2. In another preferred embodiment, the width of the flow channel is greater than the width of the faceplate slit, as shown in FIGS. 1A and 1B.

In a first embodiment of the present invention, as shown in FIGS. 1 A and 2, the first and second edges are straight and parallel. In a preferred embodiment, as shown in FIG. 2, the thickness of the upper and lower extension plates is no greater than 0.75 inches. In another preferred embodiment, the thickness of the upper and lower extension plates is no greater than 0.5 inches.

Figure 3:
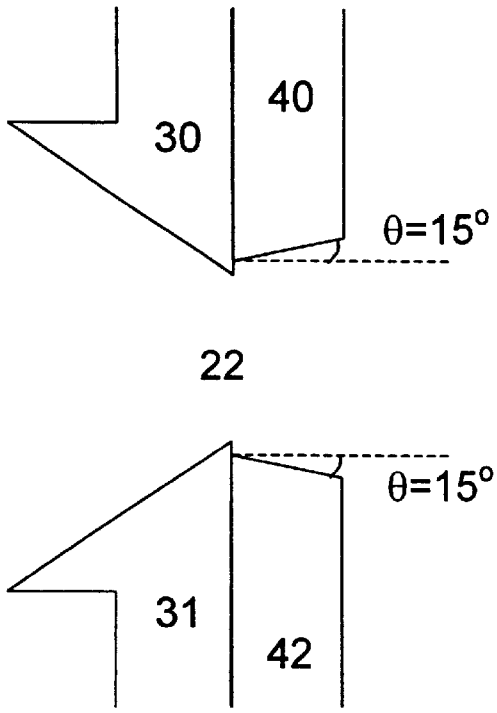
FIG. 3 is a side cross sectional view of a second embodiment of a faceplate and extension plate of the present invention.

A second embodiment of the present invention is shown in FIG. 3. In this embodiment, the first and second edges are inclined at an acute angle with respect to each other such that the distance between them increases as the distance from the nosepiece increases. In a preferred embodiment, the first and second edges are at a 30° angle with respect to each other.

In a preferred embodiment, the thickness of the upper and lower extension plates is no greater than 0.5 inches.

Figure 4:
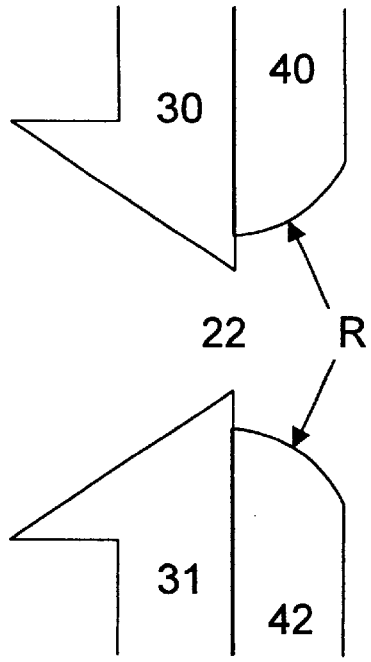
FIG. 4 is a side cross sectional view of a third embodiment of a faceplate and extension plate of the present invention.

A third embodiment of the present invention is depicted in FIG. 4. In this embodiment, the first and second edges each comprise a curve facing away from the faceplate. In a preferred embodiment, the curve of each edge defines a radius of curvature, R, of 0.5 inches. In another preferred embodiment, as shown in FIG. 4, the thickness of the upper and lower extension plates is no greater than 0.6 inches.

The foregoing disclosure and description of the invention are illustrative and explanatory. Various changes in the size, shape, and materials, as well as in the details of the illustrative embodiments may be made without departing from the spirit of the invention.

What is claimed is:

1. A melt blowing die comprising:

a. resin nosepiece comprising an outer nosepiece surface, a tip, and a resin channel extending to said tip, wherein said tip points in a forward direction;

b. an air channel adjacent to said outer surface and comprising a forward segment extending beyond the tip of said nosepiece;

c. an upper faceplate comprising an outer upper faceplate surface facing in a forward direction away from said tip wherein said outer upper faceplate surface is straight along its entire length; and d. a lower faceplate comprising an outer lower faceplate surface facing in a forward direction away from said tip, wherein said outer lower faceplate surface is straight along its entire length, said lower faceplate being spaced apart from said upper faceplate to define a faceplate slit that is aligned with the forward segment of the air channel;

e. an upper extension plate mounted on the outer upper faceplate surface and comprising a first edge; and f. a lower extension plate mounted on the outer lower faceplate surface and comprising a second edge spaced apart from said first edge to define a flow channel in alignment with said faceplate slit.

2. The apparatus of claim 1, wherein said first and second edges are straight and parallel.

3. The apparatus of claim 2, wherein the thickness of said upper and lower extension plates is no greater than 0.75 inches.

4. The apparatus of claim 2, wherein the thickness of said upper and lower extension plates is no greater than 0.5 inches.

5. The apparatus of claim 1, wherein said first and second edges are inclined at an acute angle with respect to each other such that the distance between them increases as the distance from said nosepiece increases.

6. The apparatus of claim 5 wherein the angle of incline is 30°.

7. The apparatus of claim 5, wherein the thickness of said upper and lower extension plates is no greater than 0.5 inches.

8. The apparatus of claim 1, wherein the first and second edges each comprise a curve facing away from said faceplate.

9. The apparatus of claim 8 wherein each curve is defined by a radius of curvature of 0.5 inches.

10. The apparatus of claim 8, wherein the thickness of said upper and lower extension plates is no greater than 0.6 inches.

11. The apparatus of claim 1, wherein the width of said flow channel is in the range of 0.25 to 1.0 inches.

12. The apparatus of claim 11, wherein the thickness of said upper and lower extension plates in the range of 0.25 to 1.0 inches.

13. The apparatus of claim 12, wherein the width of said flow channel is greater than the width of said faceplate slit.

14. A melt blowing die comprising:

a. a resin nosepiece comprising an outer nosepiece surface, a tip, and a multiplicity of resin channels extending to said tip, wherein said tip points in a forward direction;

b. an air channel adjacent to said outer surface and comprising a forward segment extending beyond the tip of said nosepiece;

c. an upper faceplate comprising a straight outer upper faceplate surface facing in a forward direction away from said tip, wherein said outer upper faceplate surface is straight along its entire length;

d. a lower faceplate comprising a straight outer lower faceplate surface facing in a forward direction away from said tip, wherein said outer lower faceplate surface is straight along its entire length, said lower faceplate being spaced apart from said upper faceplate to define a faceplate slit that is aligned with the forward segment of the air channel;

e. an upper extension plate mounted on the outer upper faceplate surface and comprising a first edge; and f. a lower extension plate mounted on the outer lower faceplate surface and comprising a second edge spaced apart from said first edge to define a flow channel in alignment with said faceplate slit.

15. The apparatus of claim 14 wherein said resin channels are spaced apart at a linear density in the range of 20 to 35 channels/inch.

16. The apparatus of claim 14, wherein said first and second edges are straight and parallel.

17. The apparatus of claim 16, wherein the thickness of said upper and lower extension plates is no greater than 0.5 inches.

18. The apparatus of claim 14, wherein the first and second edges each comprise a curve facing away from said faceplate.

19. The apparatus of claim 14, wherein said first and second edges are inclined at an acute angle with respect to each other such that the distance between them increases as the distance from said nosepiece increases.

* * * * *